US006752344B1

(12) United States Patent
Biagiotti

(10) Patent No.: US 6,752,344 B1
(45) Date of Patent: Jun. 22, 2004

(54) MACHINE AND METHOD FOR THE PRODUCTION OF ROLLS OF IMPREGNATED WEB MATERIAL

(75) Inventor: Guglielmo Biagiotti, Lucca (IT)

(73) Assignee: Fabio Perini S.P.A., Lucca (IT)

( * ) Notice: Subject to any disclaimer, the term of this patent is extended or adjusted under 35 U.S.C. 154(b) by 0 days.

(21) Appl. No.: 10/148,394

(22) PCT Filed: Nov. 28, 2000

(86) PCT No.: PCT/IT00/00485

§ 371 (c)(1),
(2), (4) Date: Jul. 25, 2002

(87) PCT Pub. No.: WO01/40090

PCT Pub. Date: Jun. 7, 2001

(30) Foreign Application Priority Data

Dec. 2, 1999 (IT) ..... FI99A0245

(51) Int. Cl.[7] ..... B65H 35/10

(52) U.S. Cl. ..... 242/521; 242/542.1; 242/541.2; 242/542.2

(58) Field of Search ..... 242/521, 542.1, 242/547.2, 541.2, 908

(56) References Cited

U.S. PATENT DOCUMENTS 4,487,377 A 12/1984 Perini
5,467,936 A 11/1995 Moody
5,518,200 A * 5/1996 Kaji et al. ..... 242/538.1
5,538,199 A 7/1996 Biagiotti
5,639,046 A 6/1997 Biagiotti
5,654,031 A * 8/1997 Delmore et al. ..... 427/8
5,730,387 A * 3/1998 Yamazaki ..... 242/532.3
5,879,515 A * 3/1999 Straub et al. ..... 162/275
6,045,085 A * 4/2000 Andersson et al. ..... 242/532.3
6,179,235 B1 * 1/2001 King ..... 242/160.1
6,467,719 B1 * 10/2002 Rodriguez ..... 242/521

FOREIGN PATENT DOCUMENTS

EP 0 842 881 A2 5/1998
EP 0 842 881 A3 6/1998

* cited by examiner

*Primary Examiner*—Donald P. Walsh
*Assistant Examiner*—Jonathan R Miller
(74) *Attorney, Agent, or Firm*—Breiner & Breiner, L.L.C.

(57) ABSTRACT

A peripheral winding machine for the production of rolls of wound web material is described, comprising a feed path for the web material (N), winding means (1, 3, 5) for winding said web material into rolls (L), and a zone for interruption of the web material along said feed path and upstream of said winding means, characterized in that it comprises applicator members (7B) for applying a moistening product to said web material upstream from said winding means and downstream from said interruption zone.

35 Claims, 4 Drawing Sheets

MACHINE AND METHOD FOR THE PRODUCTION OF ROLLS OF IMPREGNATED WEB MATERIAL

DESCRIPTION

1. Technical Field

This invention relates to a method for the production of articles of manufacture comprising a web product soaked or moistened with a product having a liquid base. The invention also relates to a winding machine for the production of rolls of soaked or moistened web material.

2. State of the Art

Products known as refreshing, disinfectant or detergent wipes comprising sheets of paper material soaked in an aqueous solution of detergents, soaps and perfumed or other substances are currently manufactured. Normally these wipes are packed individually in sealed sachets. In some cases multiple packs are constructed, which contain a plurality of moistened wipes which can be removed from the pack individually.

OBJECT AND SUMMARY OF THE INVENTION

The object of the present invention is to provide a method and a device for the production of rolls of web material, for example but not exclusively of absorbent paper material, soaked or moistened with substances having a liquid base containing detergents, soaps, perfumed oils, disinfectants or other components.

Substantially the invention provides a method for the production of rolls of wound web material in which the web material is fed along a feeding path to a winding zone where it is wound to form rolls, and in which characteristically a moistening product is applied to the web material upstream from the winding zone. The roll is obtained in this way by winding a web material which has already been impregnated with detergent, deodorant, moisturizing, disinfectant or other products with which it is desired that the finished product be impregnated.

In practice the method comprises the stages of:

feeding the web material along a feed path to a winding zone in which said web material is wound to form a first roll, when winding of said first roll is complete, acting on said web material in an interruption zone to produce an interruption in the web material and produce a free end of web material, beginning the winding of a second roll from said free end.

In accordance with the invention the method is characterized in that a moistening product is applied to the web material along said feed path between the interruption zone and the winding zone.

By interruption zone is generally meant a zone along the web material feed path in which a force is applied to the latter which is intended to cause the breakage, tearing, cutting or in general interruption of the web to conclude the winding of a first roll and produce the free leading edge for formation of a subsequent roll. The interruption zone may be that in which a blade acts on the web material in order to cut it. Alternatively, the interruption zone may be the zone in which a moving member pinches the web material against a fixed member or another member moving at an appropriately different speed. For example the interruption zone may be a zone in which an oscillating or rotating member presses the web material against a feed and/or winding member, for example a winding roller or belt. Alternatively, it may be a zone in which a tubular winding core or a winding mandrel presses the web material against the feed or winding member, or against a fixed or moving surface. In general, the interruption zone may coincide with the zone in which the free end of web material is formed; this occurs for example when a cutting blade is used. However, more generally, the interruption zone need not necessarily coincide with the zone where the free end is produced, which latter may typically be downstream from the interruption zone, at a point where tearing occurs as a result of overtensioning of the web material.

The method may advantageously be based on a winding system known as a peripheral or surface winding system, that is one in which the roll is formed in a winding cradle formed by winding members, such as typically rollers or belts or combinations thereof which contact the surface of the forming roll and keep it rotating.

In this embodiment it may be provided that the web material is passed round one of the winding members. In this case the moistening product is applied, for example by spraying, to the web material while the latter travels around the winding member. In this way the advantage is achieved that the web material is supported by the surface of the winding member while application takes place, and therefore prevents damage to the material. Also, the moistening product is applied in this way immediately upstream from the point where the web material is wound onto the forming roll, and furthermore the web material is substantially supported by the winding member from the point at which the moistening product is applied to the point where it is wound. This has the result that the weakening of the web material resulting from absorption of the moistening product does not result in any risk of breakage during winding. This aspect is particularly important in that the web material typically comprises paper known as "tissue", non-woven fabric or other material of little substance and mechanical strength which tends to weaken as a result of the absorption of liquids.

It may also be provided that the web material is passed around a cutting roller and passes from this to one of the peripheral winding members. In this case the liquid may be applied to the web material while it is passed around the cutting roller, advantageously downstream from the cutting zone. In this case too there is substantial support for the moistened web material until it is wound.

More generally it is particularly advantageous to provide that the liquid product be applied downstream of the changeover zone. By changeover zone is meant generically that zone in which the formation of a new roll takes place at the start of each winding. The changeover zone may be a zone in which the leading end of the web material is transferred to a winding mandrel or core. If winding takes place without a core or without a mandrel the changeover is the stage in which the leading edge of the web material begins to wind or curl upon itself to form the initial core and thus the first turns of a new roll.

Means for interrupting the web material are normally provided along the path traveled by the web material. The interruption of web material makes it possible to interrupt winding of the latter onto a now complete roll and begin the winding of a new roll.

When means for interruption of the web material are provided the moistening product is applied between the position at which the means of interruption act and the point at which winding of the roll takes place. The means of interruption may be any known means, for example a blade, a presser which breaks the web material by pinching it against a suitable surface, for example even the surface of one of the winding members, a vacuum system, or other means suitable for achieving interruption of the web material through cutting, tearing, perforation and tearing, overtensioning or otherwise.

In accordance with a particularly advantageous embodiment of the method according to the invention, a rolling plate is provided upstream from the winding zone along the feed path for the web material. The roll of web material is caused to roll along the rolling plate in the first stage of winding, towards the winding cradle where the roll is formed, winding being completed between the winding members. Means for spraying the moistening product are also provided at a terminal part of the winding plate close to the winding cradle.

The roll is preferably wound without a central winding core, for example using a winding system of the type described in U.S. Pat. No. 5,639,046 or U.S. Pat. No. 5,538,199.

In accordance with the invention a winding machine is provided for the production of rolls of wound web material which comprises a feed path for the web material and winding means to wind the web material and form said rolls. Characteristically, applicator members for applying a moistening product to the web material while this is fed along said feed path are provided upstream from the winding means.

The winding means are advantageously of the surface or peripheral type, that is they comprise peripheral winding means which form a winding cradle and which are in contact with the outer surface of the forming roll and which cause it to rotate by transmitting rotational movement by friction. In this case the winding means comprise belts, winding rollers or combinations thereof, or equivalent peripheral winding members. The applicator members are advantageously and preferably associated with one of the peripheral winding members along which the web material is passed prior to reaching the winding point.

Peripheral winding may take place on a central winding core which is then retained within the finished product. In this case the winding core is preferably constructed of a plastics or otherwise non-absorbent material, in order to retain a uniform liquid content throughout the wound web material, including the first turns. Attentively the winding core may comprise a removable mandrel which is subsequently removed from the wound roll. In accordance with the preferred embodiment however, winding takes place without a central core and without a mandrel, the leading end of the web material being wound onto itself.

In accordance with a particularly advantageous embodiment of the winding machine according to the invention, a rolling plate is located along the web material feed path upstream from the winding zone. The rolling plate ends close to the winding cradle and extends partly around a peripheral winding member around which the web material is fed, forming in effect a transfer channel for said web material with said winding member. In this configuration the applicator members are advantageously associated with the terminal end of the plate which lies closest to the winding cradle.

The applicator members may be constructed within said rolling plate, for example in a terminal portion thereof of comb construction. In this case provision may be made for the applicator members to be constructed in the form of nozzles formed by holes made in the plate. The plate itself may be a member formed from a plurality of assembled components, for example a sheet and a terminal comb portion which together form a single piece.

Further possible advantageous features and embodiments of the winding machine and the method according to the invention are indicated in the appended claims.

BRIEF DESCRIPTION OF THE DRAWINGS

The invention will be better understood from the description and the appended drawing which shows a non-restrictive practical embodiment of the invention. In the drawing.

DETAILED DESCRIPTION OF THE PREFERRED EMBODIMENT OF THE INVENTION

Figure 1:
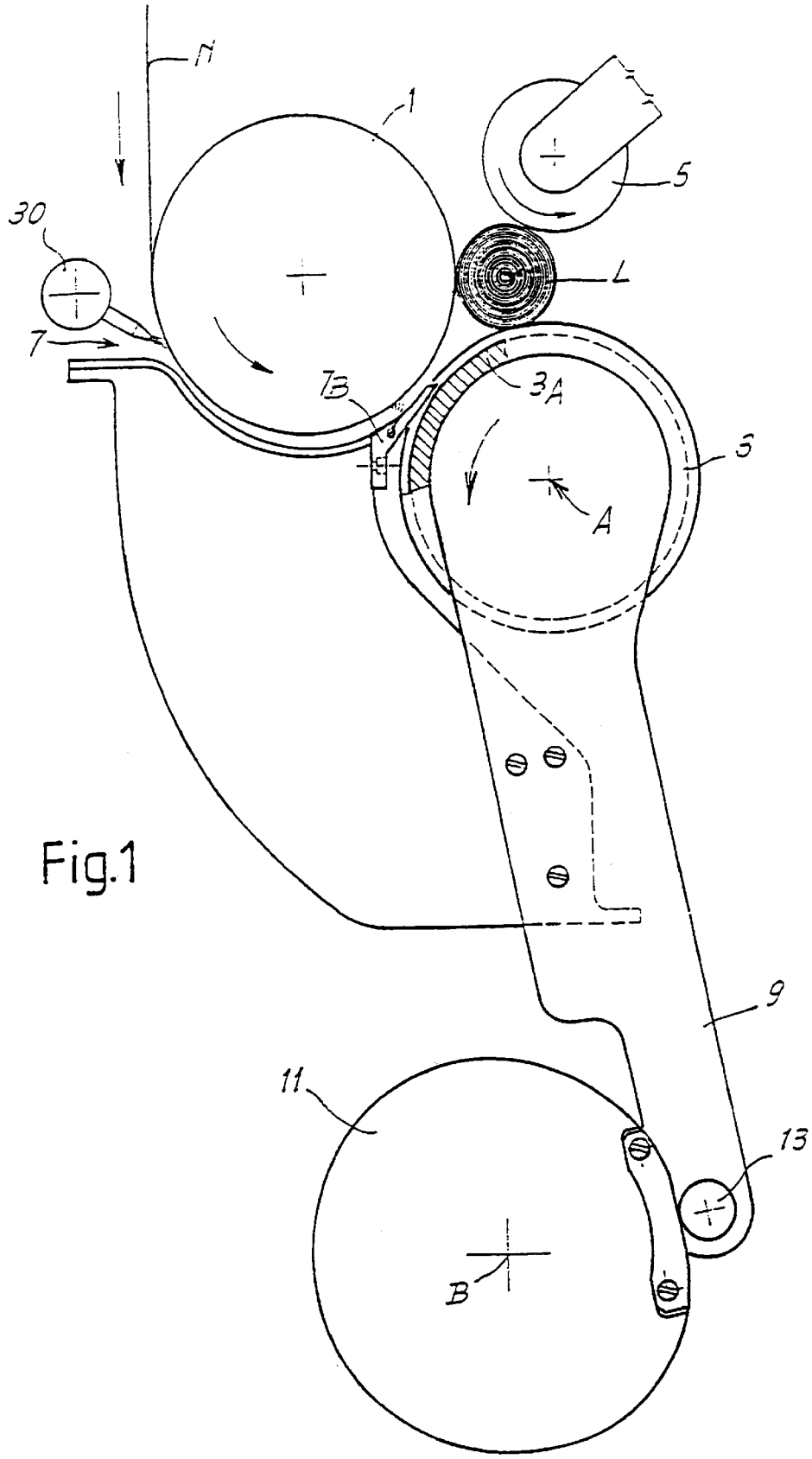
FIG. 1 shows the winding zone of a surface winding machine to which this invention is applied.

FIG. 1 provides a lateral view of the winding zone of a winding machine in which this invention is implemented. The winding machine is of the peripheral type which winds without a central winding mandrel or core, of the type described in greater detail in U.S. Pat. No. 5,639,046, to which reference may be made for greater detail. This description will be restricted to the items which are necessary for an understanding of this invention.

The winding machine has a winding cradle defined by three rollers 1, 3, 5, in which roller 5 and possibly one of rollers 1 or 3 or both move to allow the roll or log L forming in the winding cradle to grow. Upstream from the nip formed between the two winding rollers 1 and 3 there is an oscillating plate 7 supported by an oscillating arm 9 hinged about an axis A which coincides with the axis of rotation of winding roller 3.

Oscillating plate 7 is formed from a sheet 7A and a terminal comb member 7B, the teeth 7C of which (FIG. 2) are inserted into annular grooves 3A in winding roller 3. The unit comprising oscillating arm 9, sheet 7A and comb member 7B oscillates around axis A through the effect of a cam 11 which rotates about an axis B and acts together with a contact member 13 borne by arm 9. An elastic member such as a spring or other member, not shown, ensures that contact is maintained between the cam and the contact member.

Web material N is fed around winding roller 1 and is delivered from a perforating unit, not shown. Web material N is then wound around roll or log L which is kept in rotation by three rollers 1, 3, 5 in the winding cradle, until the desired quantity of web material has been wound onto log L. Once winding is complete log L is removed from the winding cradle in a known manner, for example by acting on the peripheral speed of one or both winding rollers 3 and 5, while oscillating plate 7 is caused to oscillate upwards (that is clockwise) so as to cause the web material to be pinched between said plate and winding roller 1. This causes both the web material to tear between the completed roll and the pinch point and the free end so produced to wind upon itself to start the formation of a new roll.

The machine and the method of winding briefly described heretofore are already known to those skilled in the art (see U.S. Pat. No. 5,639,046).

In accordance with the invention a liquid-based product which impregnates or moistens the material before forming roll or log L is applied to web material N. With this object, in the embodiment illustrated, terminal comb member 7B of plate 7 has a series of nozzles which spray liquid product onto web material N as this passes by and is delivered to winding roller 1 in the direction of forming roll or log L.

Figure 2:
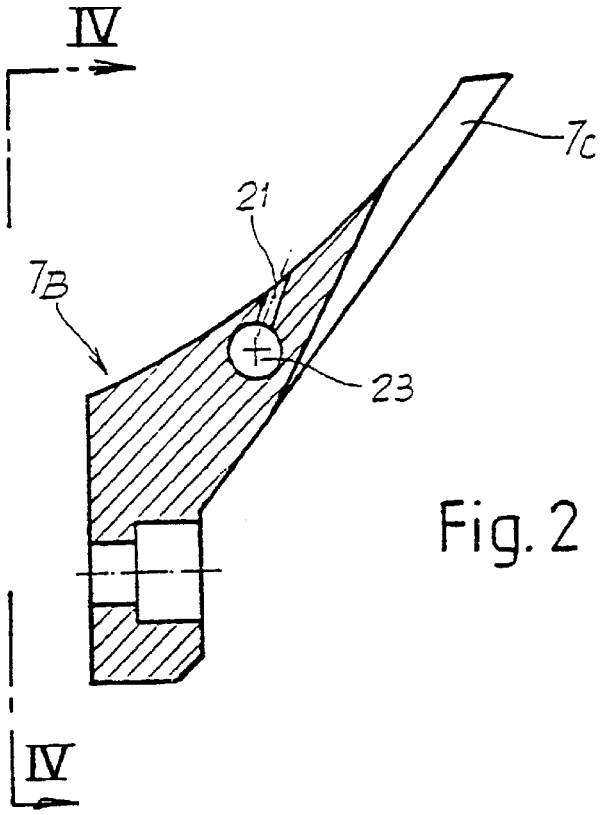
FIG. 2 shows a magnified cross-section along II—II in FIG. 4 of the terminal comb portion of the rolling plate for the roll during the first stage of the winding cycle.
Figure 4:
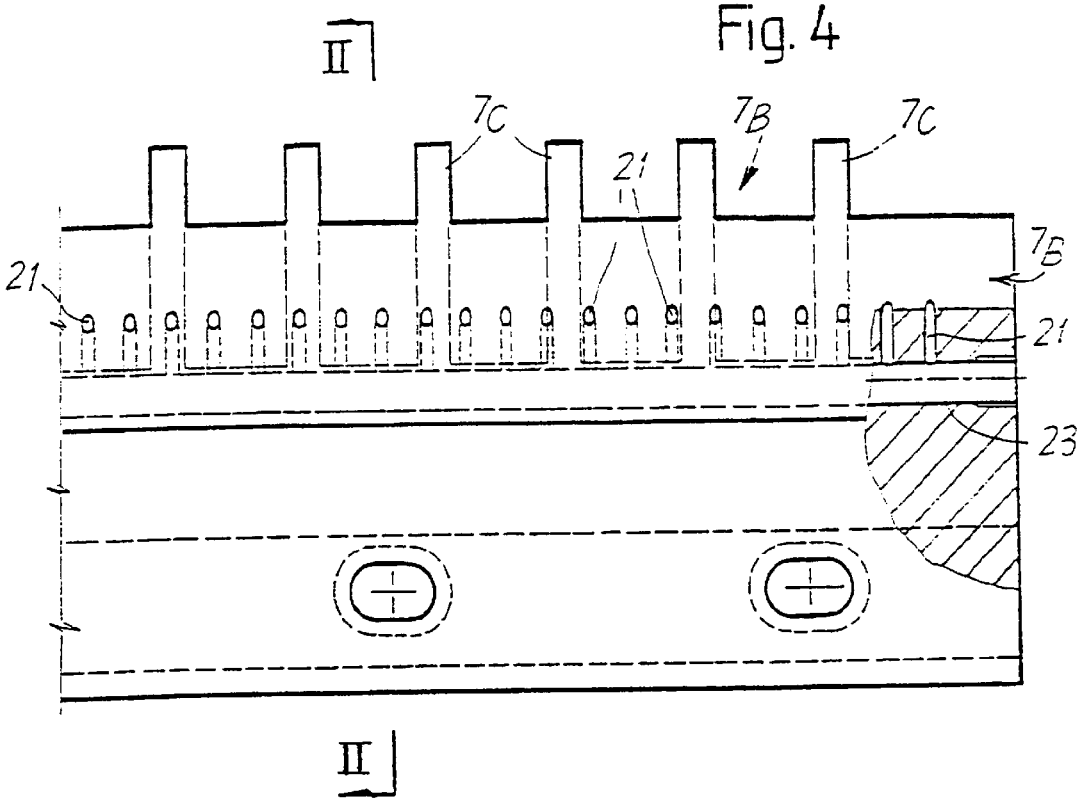
FIG. 4 shows a frontal view along IV—IV in FIG. 2.

FIGS. 2 and 4 show a first possible configuration of these nozzles, which are indicated therein by 21. These are distributed in a substantially uniform way along the entire longitudinal length of terminal comb member 7B, that is along the transverse direction of web material N. Nozzles 21 are connected to a duct 23 constructed in the body of the terminal comb member, which feeds the liquid which has to be sprayed to the individual nozzles 21. Duct 23 may be fed from outside at the end of the comb member, and also at any intermediate points along the longitudinal length of duct 23 itself, in order to obtain an approximately constant pressure and therefore a flow of liquid and an exit velocity from the individual nozzles which are sufficiently uniform along the entire transverse extent of the web material.

Nozzles 21 are opportunely orientated towards the ends of teeth 7C of comb member 7B. In this way the jets of liquid generated by the nozzles are orientated towards the nip formed between winding rollers 1 and 3 and therefore intercept web material N in a position which is as close as possible to the point in which the web material is detached from the surface of winding roller 1 and winds onto log L. This reduces the risks of breakage of web material N through weakness caused by moistening.

Figure 3:
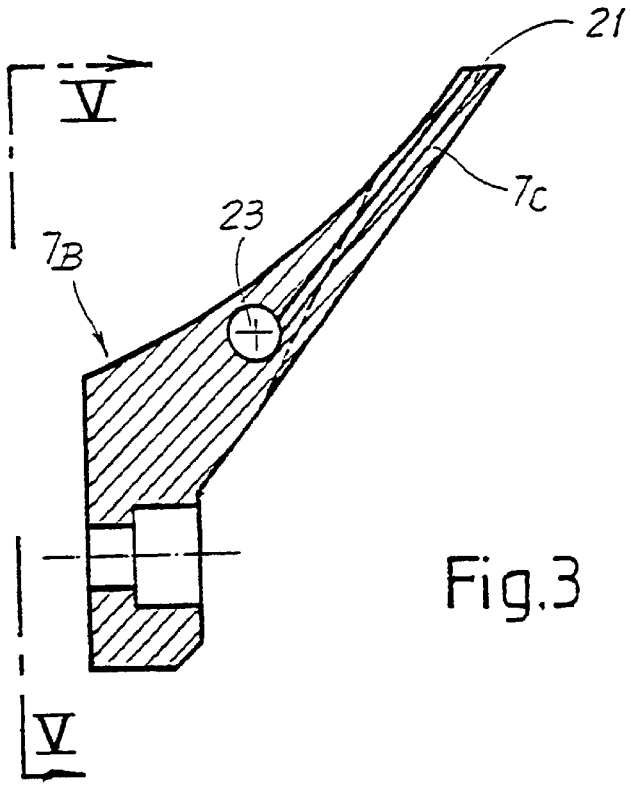
FIG. 3 shows a cross-section similar to that in FIG. 2 along III—III in FIG. 5 in a different embodiment.
Figure 5:
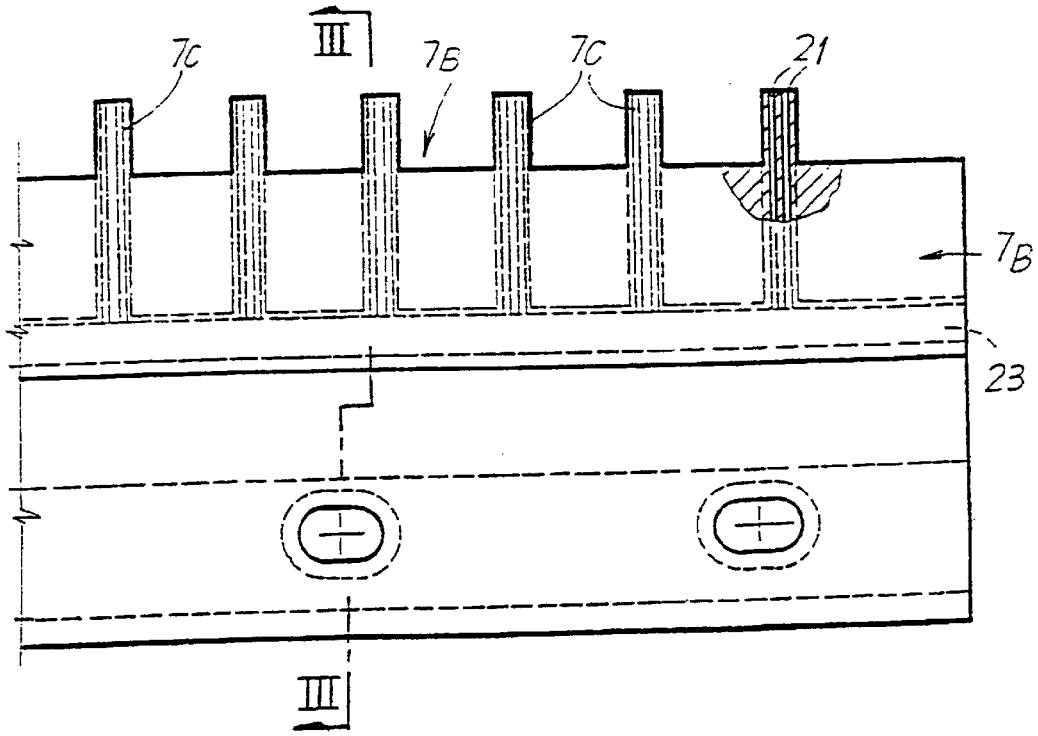
FIG. 5 shows a frontal view along V—V in FIG. 3, and FIG. 6 provides a diagrammatical view of a different embodiment.

FIGS. 3 and 5 show a modified embodiment in which the same reference numbers indicate the same or equivalent parts as in FIGS. 2 and 4. In this case the nozzles are constructed in the teeth 7C of comb member 7B and therefore open out in a position which is even closer to the zone where log L is formed. Nozzles 21 are also fed through a duct 23 constructed within the thickness of comb member 7B at the base of teeth 7C.

A pair of nozzles which are orientated in a divergent manner are provided in each tooth 7C. This increases the uniformity with which the sprayed liquid is distributed.

The possibility of also constructing nozzles 21 as separate members from comb member 7B, making space to house them in annular seats in winding roller 3, is not ruled out.

As an alternative it may be provided that the nozzles are housed within winding roller 1 or winding roller 3, in a fixed position and orientated so as to intercept the web material in a zone suitably located close to the winding point. In this case the nozzles can for example spray through previous zones of winding roller 1 or winding roller 3.

In any event, in the arrangement illustrated or the alternatives mentioned above the web material is moistened downstream from the point where the "changeover" occurs, that is where the interrupted web material begins the formation of a new roll. In the example illustrated the changeover zone is substantially represented by the zone in which the free end of web material obtained by tearing begins to wind upon itself to form the initial core of a new roll. With this invention this changeover, which constitutes a critical operation in the winding process, is caused to take place with material which is substantially dry. The presence of moisture or liquid impregnating the material would make the changeover difficult or would in some cases even render it impossible, with the consequence that the winding process could not be performed continuously. These difficulties may be caused not only by the reduced strength of the wetted material but also by the increase in centrifugal force produced by the increase in the specific gravity of the wetted material. Furthermore, the possible use of soaps or softeners in the applied liquid reduces the friction coefficient between the web material and the members of the machine in contact with it at the time of changeover. The consequent slippage may prejudice or create difficulties for changeover.

In order to ensure that the changeover zone remains dry, provision may also be made for the presence of nozzles 30 located upstream from oscillating plate 7. These nozzles generate a jet of dry air which removes any moisture originating in the zone where the web material is sprayed from the changeover zone.

Figure 6:
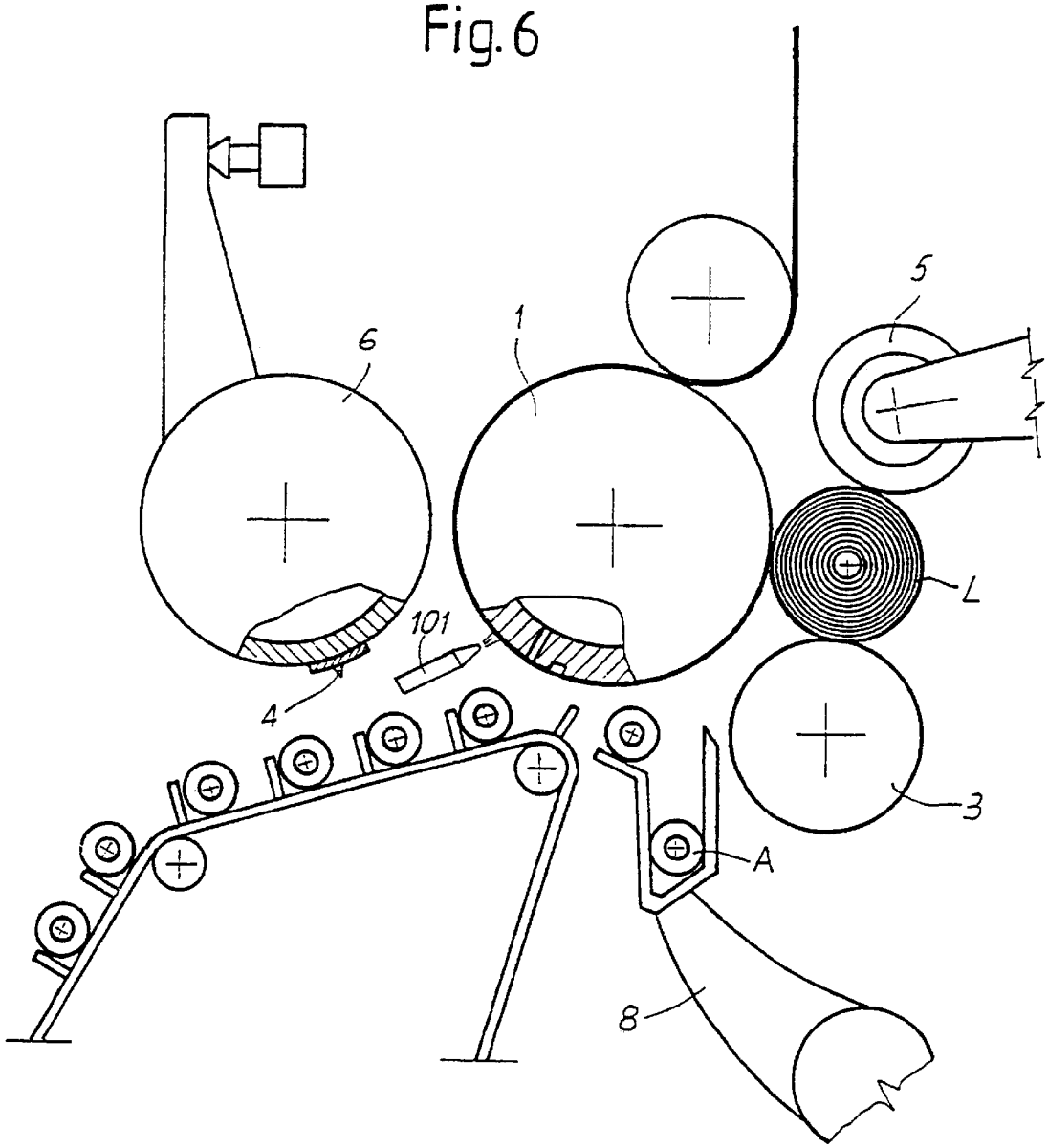

FIG. 6 shows an embodiment in which winding is performed on tubular winding cores, for example of plastics material. The structure of the winding zone is similar to that described in U.S. Pat. No. 4,487,377, to which reference may be made for greater detail. The winding cradle is formed by three winding rollers 1, 3, 5. Winding roller 1 also has a cutting channel which acts together with a blade 4 mounted on a blade-holding roller 6. Winding roller 1 therefore also constitutes a cutting roller. In this way, once a roll or log L has been wound blade-holding roller 6 causes blade 4 to act together with the channel or counterblade in the cutting and winding roller 1 effects interruption of the web material. A pneumatic or mechanical retaining system associated with roller 1 transfers the leading end of the cut material to the new winding core A which is inserted by a pusher 8 into the nip between rollers 1 and 3. Downstream from the zone where cutting of the web material takes place, that is from the nip between rollers 1 and 6, there is located a set of spray nozzles 101 which spray the liquid against the web material when the latter is supported on roller 1. In this configuration too there is the advantage that the web material is supported on a mechanical member (roller 1) when it is wetted, avoiding risks of breakage.

Alternatively, and in a way which is in itself known, the web material may also be cut by means of a cutting roller which is separate from winding roller 1, and which may be located upstream of the latter in the direction of advance of the web material. In this case means are provided for transferring the free leading end of the web material from the roller on which cutting takes place to the winding roller. An arrangement of this type is for example illustrated in U.S. Pat. No. 4,962,897. Again in a configuration of this type the spray nozzles are advantageously associated with the cutting roller or the subsequent winding roller and spray the liquid downstream from the cutting zone.

A configuration with a cutting blade and a cutting roller may also be constructed for winding without a central winding core.

It is to be understood that the drawing only illustrates an embodiment which has merely been provided as a practical demonstration of the invention, and this invention may vary in form and arrangement without thereby going beyond the scope of the concept underlying the invention.

What is claimed is:

1. Method for producing rolls of wound web material, comprising the stages of:

feeding the web material along a feed path to a winding zone in which said web material is wound to form a first roll, when winding of said first roll is complete, acting on said web material in an interruption zone to produce an interruption in the web material and produce a free end of web material, beginning the winding of a second roll from said free end, wherein a moistening product is applied to the web material along said feed path between the interruption zone and the winding zone to provide rolls of soaked or moistened web material.

2. Method according to claim 1, further comprising arranging a winding cradle defined by peripheral winding members in contact with a forming roll.

3. Method according to claim 2, wherein said moistening product is applied to the web material at one of said winding members to which the web material is fed.

4. Method according to claim 2 or 3, further comprising providing a rolling surface upstream from the winding zone along which the roll is caused to roll towards the winding cradle, and wherein means for spraying the moistening product are arranged at a terminal part of the rolling surface close to the winding cradle.

5. Method according to claim 2, wherein a changeover zone in which a leading free end of the web material begins the formation of a new roll is provided along said feed path, said moistening product being applied downstream from said changeover zone in the direction of advance of the web material along said path.

6. Method according to claim 2, 3 or 5, wherein a device for interrupting the web material is provided along said feed path upstream from the winding zone; and that said moistening product is applied to the web material while the web material is in transit between the device for interrupting the web and the winding zone, wherein said device for interrupting the web acts together with a winding roller, said winding roller being one of said peripheral winding members.

7. Method according to claim 1, wherein said web material is wound without a central winding core.

8. Method according to claim 1, wherein a changeover zone in which a leading free end of the web material begins the formation of a new roll is provided along said feed path, said moistening product being applied downstream from said changeover zone in the direction of advance of the web material along said path.

9. Method according to claim 1, 2, 3, 5 or 8, wherein a device for interrupting the web material is provided along said feed path upstream from the winding zone; and that said moistening product is applied to the web material while the web material is in transit between the device for interrupting the web and the winding zone.

10. Method according to claim 9, wherein said device for interrupting the web comprises a blade and a roller around which said web material is fed, said blade acting together with said roller, and in that said moistening product is sprayed onto the web material while the web material is passed around said roller.

11. Method according to claim 8, wherein an interruption device acts together with a winding roller, said winding roller being a peripheral winding member.

12. Peripheral winding machine for the production of rolls of wound web material comprising a feed path for a web material, winding means for winding said web material in rolls, and a zone for interruption of the web material along said feed path and upstream from said winding means, wherein applicator members are located upstream from said winding means and downstream from said interruption zone for application of a moistening product to said web material to provide rolls of soaked or moistened web material.

13. Winding machine according to claim 12, wherein said winding means comprise a winding cradle with peripheral winding members in contact with the forming roll.

14. Winding machine according to claim 13, wherein said applicator members are located at one of said peripheral winding members along which said web material is passed in order to apply said moistening product to the web material which is in contact with said winding member.

15. Winding machine according to claim 13, wherein said applicator members comprise a set of spray nozzles.

16. Winding machine according to claim 13 or 15, further comprising a device for interrupting the web material upstream from said winding means along said feed path and in which the applicator members are located along the feed path between the winding means and the device for interrupting the web material, wherein said device for interrupting the web material comprises a blade which acts together with a counterblade in a roller around which said web material is fed, wherein said roller equipped with said counterblade is one of said peripheral winding members.

17. Winding machine according to claim 15, further comprising a rolling plate along the feed path upstream of the winding cradle along which an initial core of the forming roll is caused to roll, said rolling plate terminating in a vicinity of the winding cradle, and in that said applicator members are associated with the terminal end of the rolling plate located in the vicinity of the winding cradle.

18. Winding machine according to claim 17, wherein:

said winding members comprise at least one winding roller equipped with a plurality of annular grooves, said rolling plate has a plurality of teeth extending into said annular grooves in the winding roller, and in that the applicator members comprise nozzles constructed in correspondence of said teeth of the rolling plate.

19. Winding machine according to claim 18, wherein said nozzles open out on said teeth.

20. Winding machine according to claim 19, wherein each tooth has two divergent nozzles.

21. Winding machine according to claim 18, wherein said nozzles are located in bases of said teeth.

22. Winding machine according to claim 21, wherein said nozzles are in communication with a feed duct constructed within said rolling plate.

23. Winding machine according to claim 12, wherein said applicator members comprise a set of spray nozzles.

24. Winding machine according to claim 12, 13, 23 or 15, further comprising a device for interrupting the web material upstream from said winding means along said feed path and in which the applicator members are located along the feed path between the winding means and the device for interrupting the web material.

25. Winding machine according to claim 24, wherein said device for interrupting the web material comprises a blade which acts together with a counterblade in a roller around which said web material is fed.

26. Winding machine according to claim 23, further comprising a rolling plate along the feed path upstream of a winding cradle along which an initial core of the forming roll is caused to roll, said rolling plate terminating in a vicinity of the winding cradle, and in that said applicator members are associated with the terminal end of the rolling plate located in the vicinity of the winding cradle.

27. Winding machine according to claim 26 or 17, wherein said spray nozzles are constructed in the rolling plate.

28. Winding machine according to claim 26, wherein:

said winding members comprise at least one winding roller equipped with a plurality of annular grooves, said rolling plate has a plurality of teeth extending into said annular grooves in the winding roller, and in that the applicator members comprise nozzles constructed in correspondence of said teeth of the rolling plate.

29. Winding machine according to claim 28, wherein said nozzles open out on said teeth.

30. Winding machine according to claim 29, wherein each tooth has two divergent nozzles.

31. Winding machine according to claim 28, wherein said nozzles are located in bases of said teeth.

32. Winding machine according to claim 31, wherein said nozzles are in communication with a feed duct constructed within said rolling plate.

33. Winding machine according to claim 26, 32, 17 or 25, wherein said rolling plate oscillates and acts together with a feed roller for the web material to cause interruption of the web material by pinching the web material against the feed roller at a point upstream from the applicator members in the feed direction of the web material.

34. Winding machine according to claim 12, 13, 23 or 28, wherein a changeover zone in which a leading end of the web material begins the formation of a roll is located along said feed path for the web material, and in that said applicator members are located downstream from said changeover zone in the feed direction for the web material along said track.

35. Winding machine according to claims 23 or 15, wherein said spray nozzles are in a rolling plate along the feed path upstream of a winding cradle.

* * * * *

UNITED STATES PATENT AND TRADEMARK OFFICE

CERTIFICATE OF CORRECTION

PATENT NO. : 6,752,344 B1
DATED : June 22, 2004
INVENTOR(S) : Guglielmo Biagiotti It is certified that error appears in the above-identified patent and that said Letters Patent is hereby corrected as shown below:

Column 3,
Line 43, "Attentively" should read -- Alternatively --.

Column 5,
Line 50, "previous" should read -- pervious --.

Column 9,
Line 13, "claim 26, 32, 17 or 25," should read -- claim 26, 32, 17 or 22, --

Column 10,
Line 4, "claim 12, 13, 23 or 28," should read -- claim 12, 13, 23 or 15, --

Signed and Sealed this

Twenty-fifth Day of January, 2005

JON W. DUDAS
*Director of the United States Patent and Trademark Office*